US009500332B2

(12) United States Patent
Jackl et al.

(10) Patent No.: US 9,500,332 B2
(45) Date of Patent: Nov. 22, 2016

(54) LIGHTING MODULE FOR A MOTOR VEHICLE

(71) Applicant: ZIZALA LICHTSYSTEME GMBH, Wieselburg (AT)

(72) Inventors: Christian Jackl, Wieselburg (AT); Clemens Hauer, Steinakirchen am Forst (AT)

(73) Assignee: ZKW GROUP GMBH, Wieselburg an der Erlauf (AT)

( * ) Notice: Subject to any disclaimer, the term of this patent is extended or adjusted under 35 U.S.C. 154(b) by 0 days.

(21) Appl. No.: 14/420,393

(22) PCT Filed: Aug. 7, 2013

(86) PCT No.: PCT/AT2013/050153

§ 371 (c)(1),
(2) Date: Feb. 9, 2015

(87) PCT Pub. No.: WO2014/028955

PCT Pub. Date: Feb. 27, 2014

(65) Prior Publication Data

US 2015/0219297 A1 Aug. 6, 2015

(30) Foreign Application Priority Data

Aug. 23, 2012 (AT) ..... A 50335/2012

(51) Int. Cl.
*F21V 1/00* (2006.01)
*F21S 8/10* (2006.01)

(52) U.S. Cl.
CPC ..... *F21S 48/115* (2013.01); *F21S 48/1109* (2013.01); *F21S 48/1159* (2013.01); *F21S 48/12* (2013.01); *F21S 48/13* (2013.01); *F21S 48/1305* (2013.01); *F21S 48/328* (2013.01)

(58) Field of Classification Search
CPC ..... F21V 17/005; F21V 17/14; F21V 17/16; F21V 17/162; F21V 21/088; F21V 21/08; F21S 48/232; F21S 48/1305; F21S 48/328; F21S 48/142; F21S 48/1104; F21S 48/1109; F21S 48/1159; F21W 2101/02
See application file for complete search history.

(56) References Cited

U.S. PATENT DOCUMENTS

2008/0291631 A1* 11/2008 Hellinger ..... F21S 48/215 362/341
2011/0019409 A1* 1/2011 Wronski ..... F21V 7/00 362/235
2012/0236563 A1* 9/2012 Breidenassel ..... F21V 17/12 362/249.02

*Primary Examiner* — Y M Lee
(74) *Attorney, Agent, or Firm* — Sutherland Asbill & Brennan LLP

(57) ABSTRACT

The invention relates to a light module (10) for a motor vehicle or for a motor vehicle headlight, wherein the light module (10) comprises:
a heat sink (6);
a carrier plate (3) for at least one light source (2);
at least one light source (2) arranged on the carrier plate (3);
wherein the carrier plate (3) is secured on the heat sink (6), wherein the carrier plate (3) has one or more reference positions (4) for referencing a light-shaping member, for example for referencing a reflector (1), and wherein the light-shaping member has a securing base (1'), by means of which securing base (1') the light-shaping member can be referenced to the at least one reference position (4) of the carrier plate (3). In accordance with the invention, the securing base (1') is assigned at least one return element (7), by means of which the securing base (1') can be secured at least temporarily in the reference position thereof in relation to the carrier plate (3).

19 Claims, 4 Drawing Sheets

LIGHTING MODULE FOR A MOTOR VEHICLE

Figure 1:
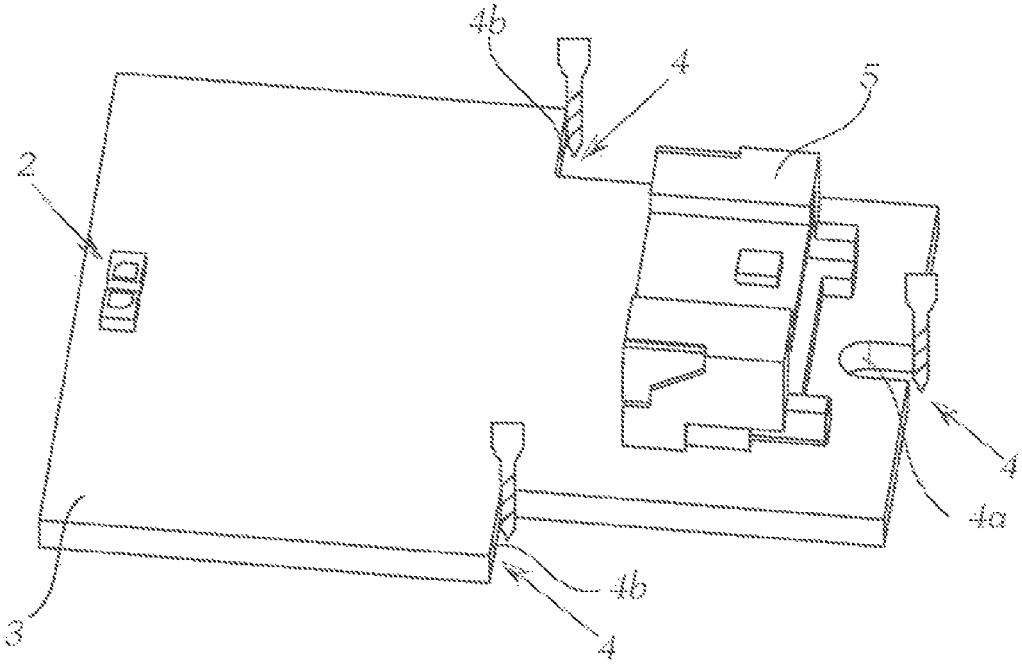

The invention relates to a light module for a motor vehicle or for a motor vehicle headlight, wherein the light module comprises:

a heat sink;

a carrier plate for at least one light source;

at least one light source arranged on the carrier plate;

wherein the carrier plate is secured on the heat sink, wherein the carrier plate has one or more reference positions for referencing a light-shaping member, for example for referencing a reflector, and wherein the light-shaping member has a securing base, by means of which securing base the light-shaping member can be referenced to the at least one reference position of the carrier plate.

The invention also relates to a vehicle headlight comprising at least one above-mentioned light module.

In order to produce a desired light distribution in the region in front of and/or behind a vehicle, a light module for a vehicle headlight or a vehicle headlight itself has one or more light sources as well as one or more light-shaping members, for example one or more reflectors. Light exiting from the light source is emitted from such a reflector as a desired light exposure into a region in front of the vehicle in which the vehicle headlight is installed.

In order to be able to produce an optimal and in particular legally compliant light exposure, the exact positioning of the light source in relation to the reflector is of particular importance. By way of example, in the case of the use of LED light sources which have one or more light-emitting diodes as light-emitting elements, the deviations from the target position must lie merely in the region of 1/10 of a millimeter, i.e. the reflector and LED light source(s) must be positioned in an extremely exact manner relative to one another.

A light module of the type described in the introduction enables an exact and at the same time simple assembly of a light module.

The object of the invention is to improve a light module to the extent that a further improved and simpler positioning and in particular reliable securing of the light-shaping member to the carrier plate are enabled.

This object is achieved with a light module of the type described in the introduction in that, in accordance with the invention, the securing base is assigned at least one return element, by means of which the securing base can be secured at least temporarily in the reference position thereof in relation to the carrier plate.

By way of example, the reference positions can be fixed once the at least one light source has been positioned on the carrier plate, such that the light-shaping member can be positioned as exactly as possible in relation to the at least one light source by alignment with these reference positions.

However, for the time being, the reference positions can also be fixed on the carrier plate and the at least one light source is then fixed on the carrier plate depending on the exact location of said reference positions.

The light-shaping member in these reference positions can be positioned exactly relative to the at least one light source and is held in this position at least temporarily by means of the at least one return element until said light source is ultimately fixed.

In order to ensure a good heat transfer from the carrier plate to the heat sink, the carrier plate is advantageously bonded to the heat sink.

In a specific embodiment in which an exact positioning of the light-shaping member is particularly important, the at least one light source is an LED light source having one or more light-emitting diodes and the carrier plate is a printed circuit board (LED print) for the at least one LED light source. Here, the at least one LED light source is preferably soldered to the printed circuit board.

In accordance with a specific embodiment of the light module according to the invention, the at least one return element is biased in the reference position of the securing base (and thus in the reference position of the reflector) between the securing base and a contact region of the heat sink, in such a way that the securing base is held in the reference position thereof in relation to the carrier plate.

At least one securing element, preferably at least two securing elements, is/are advantageously provided in order to secure the securing base on the heat sink.

By way of example, the at least one securing element here is a spring, for example a sheet metal spring, which is preferably provided in the form of a yoke spring, which for example is clipped onto the securing base and the heat sink and/or is fixed to these components.

A stable, exact and where necessary detachable securing of the light-shaping member in relation to the at least one light source is thus created.

It is further advantageous if the return element comprises at least one spring element. This one spring or the plurality of springs (for example compression springs) holds/hold the light-shaping member in the reference position thereof until said light-shaping member is fixed with the securing elements.

Simple and stable assembly is provided when the at least one spring element is formed in one piece with the securing base.

For an exact positioning of the light-shaping member, it is advantageous if the reference positions are arranged on the carrier plate in relation to the geometric centre of the at least one light source or in relation to the lightest region of the at least one light source.

By way of example, these regions can be determined using a camera.

Furthermore, in accordance with specific embodiments, the one or more reference positions is/are provided in the form of one or more holes, for example slots, and/or in the form of one or more reference edges, preferably running in a straight line.

By way of example, the reference positions can be drilled and/or milled.

The reference positions can be provided in principle in the form of webs, bores, supporting or bearing faces, slots, stops, etc.

The appropriate reference face/edge/hole that brings the light-shaping member into a clearly defined position is established depending on the application and embodiment of the light-shaping member. For example, a slot is used so that the light-shaping member can no longer shift laterally (to the left/right), whereas edges for example delimit the movement of the light-shaping member in a certain direction, for example in a direction towards the light source.

Lastly, in a specific embodiment of the invention, the heat sink has two portions which are preferably arranged at right angles to one another, wherein the carrier plate is arranged on one of the portions. The contact region for the return element is preferably fixed on one of the two portions, preferably on both portions, for example it is formed in one piece with this portion or these portions.

Figure 2:
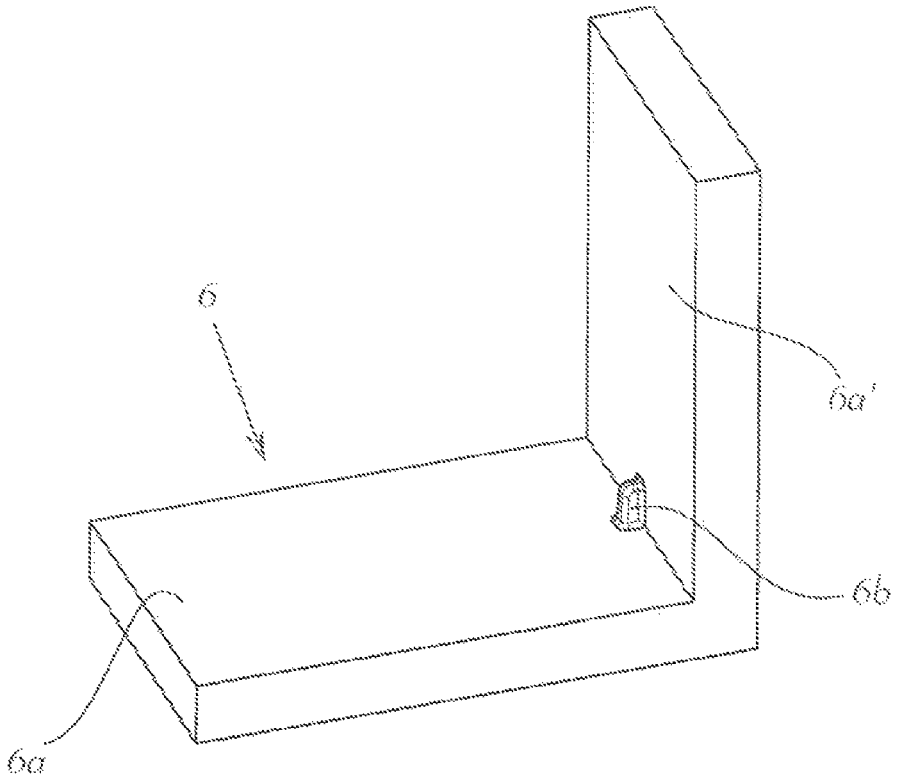
Figure 3:
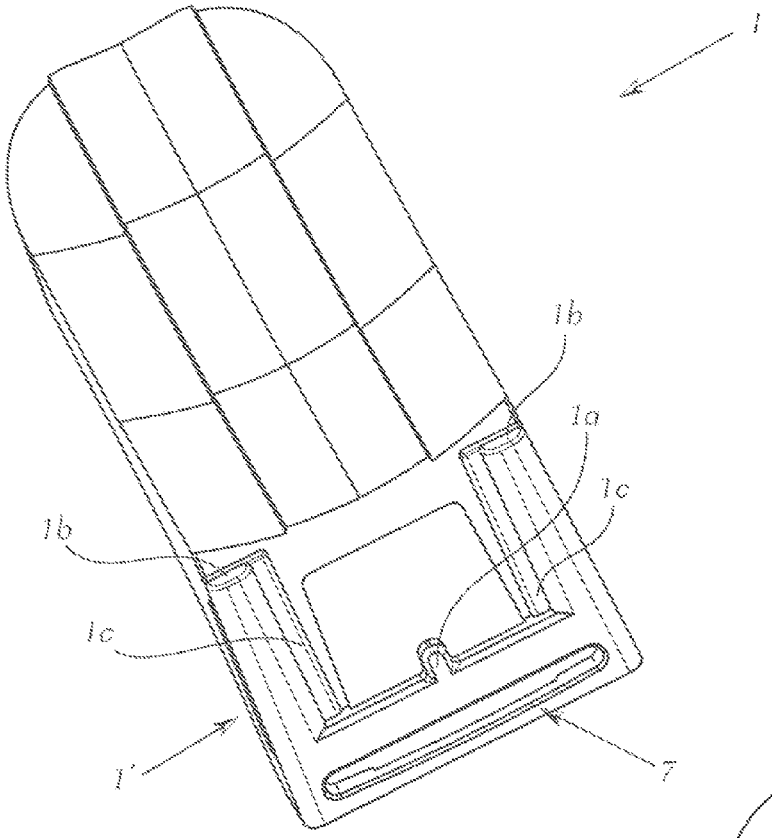
Figure 4:
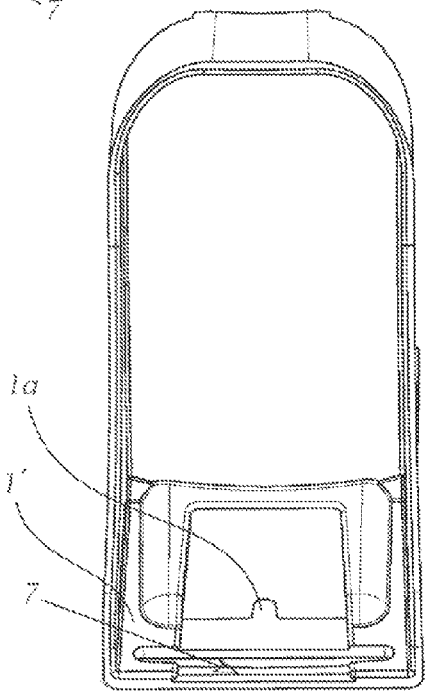
Figure 5:
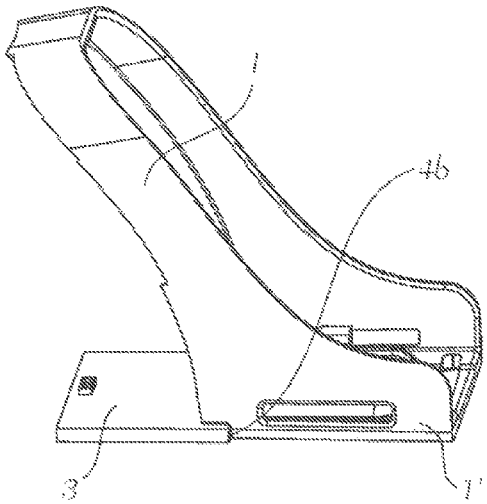
Figure 6:
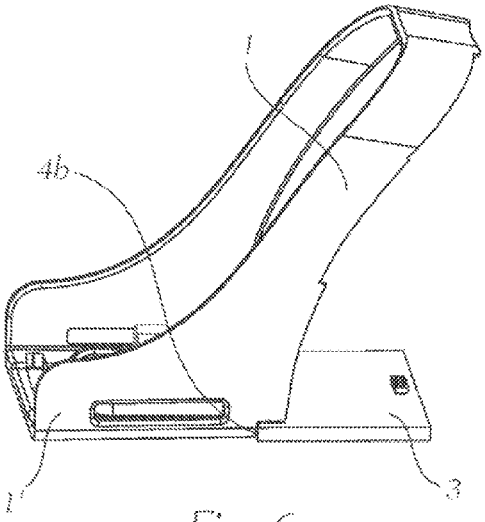
Figure 7:
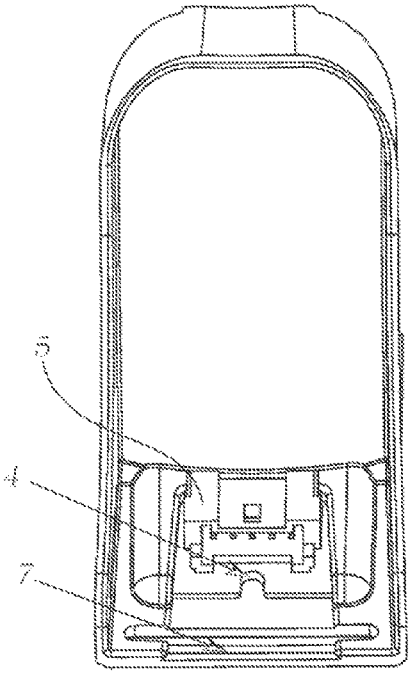
Figure 8:
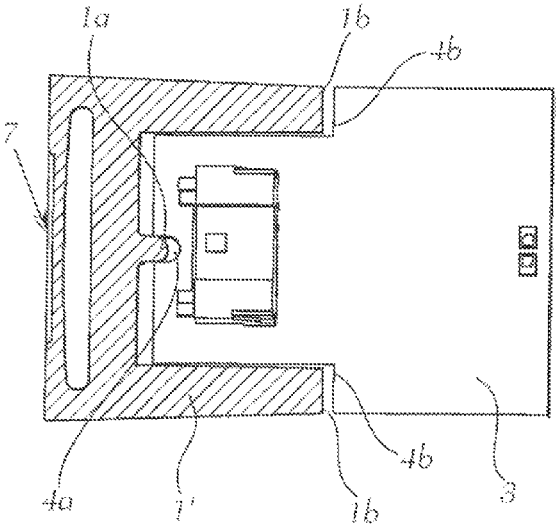
Figure 9:
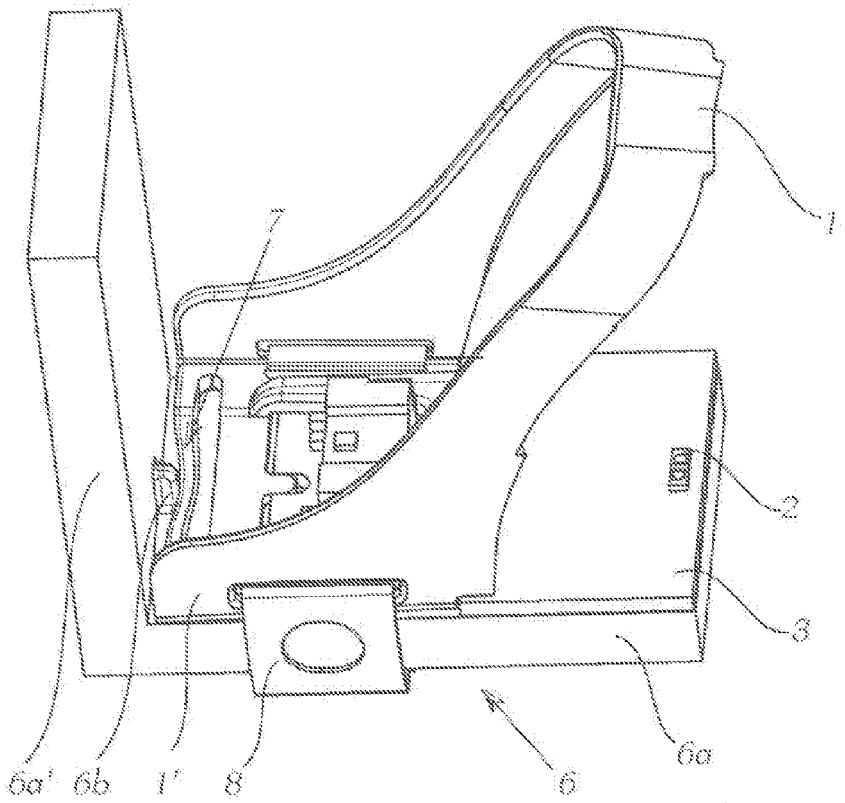
Figure 10:
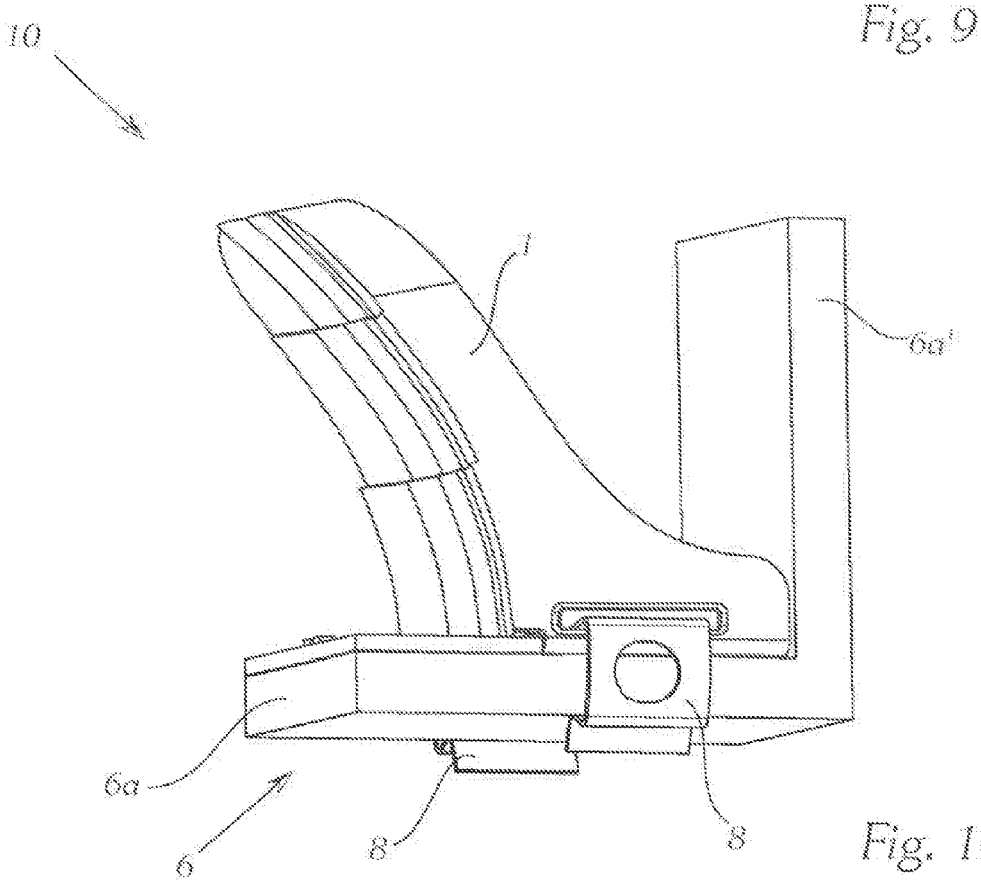

The invention is explained in greater detail hereinafter on the basis of the drawing, in which FIG. 1 shows a carrier plate with light source arranged thereon, FIG. 2 shows a heat sink for a light module according to the invention, FIG. 3 shows a reflector in a view from below, FIG. 4 shows the reflector from FIG. 3 in a view obliquely from above, FIG. 5 shows the reflector from FIGS. 3 and 4, positioned on a carrier plate, in a side view, FIG. 6 shows the arrangement from FIG. 5, in a view from the opposite side, FIG. 7 shows a view of the carrier plate from below with positioned reflector, FIG. 8 shows a view of the carrier plate with fitted reflector, obliquely from above, FIG. 9 shows a view of a reflector secured to a heat sink in relation to the carrier plate, obliquely from above, and FIG. 10 shows the arrangement from FIG. 9 in a view obliquely from below.

FIG. 1 shows a carrier plate 3, here a printed circuit board (LED print), on which a light source 2 is fixed.

In the shown variant, the light source 2 is an LED light source, which here has two light-emitting diodes. Accordingly, as already mentioned above, the carrier plate 3 is a printed circuit board for the LED light source 2. Here, the LED light source 2 is soldered to the printed circuit board 3.

Furthermore, the carrier plate 3 has a plurality of reference positions 4 for a reflector 1, wherein the position of the reference positions 4 is dependent on the position of the LED light source 2.

To this end, for example the geometric centre of the LED light source 2 or the lightest region of the LED light source 2 is determined, for example using a camera, and the reference positions are then arranged preferably under consideration of the geometric centre of the LED light source 2 or the lightest region of the LED light source 2.

The reference positions 4 in the shown example are constituted by a slot 4*a*, which is open on one side, and by two reference edges or reference planes 4*b* running in a straight line. The reference positions 4 are produced for example by drilling, milling or in another way.

Furthermore, a plug housing 5 for the electrical contacting of the LED light source 2 is also shown in FIG. 1.

The reflector 1 is referenced to the reference positions 4, i.e. is aligned with and positioned on the carrier plate 3, as is illustrated in FIGS. 5-8 from different views.

Here, as can be clearly seen in particular also in FIGS. 3 and 4, the reflector 1 in the shown embodiment has a securing base 1', which is equipped with the appropriate shaped portions corresponding to the reference positions 4*a*, 4*b*, for example an extension 1*a*, which is arranged in the slot 4*a*, and also base faces or base planes 1*b*, which bear against the reference faces 4*b* of the carrier plate 3.

In FIGS. 5 and 6 the referencing of the reflector or of the reflector base 1' to the reference faces 4*b* via the portions 1*b* thereof can be clearly seen, whereas FIGS. 5 and 6 show how the reflector 1 or the base 1' is positioned with the extension 1*a* in the slot 4*a*.

In this way, the reflector 1 is positioned on the carrier plate 3 in the desired position in relation to LED light source 1 arranged on the carrier plate 3 and is secured to the carrier plate 3 or in relation to the carrier plate 3, as is described further below.

The reflector 1 assumes the desired position by means of the reference positions 4*a*, 4*b*. In this position, the reflector 1 can be temporarily fixed with a return element 7, for example in the form of a spring (for example a compression spring); the return element 7 here holds the reflector 1 or generally the light-shaping member in the reference position thereof (desired position) until said light-shaping member is ultimately fixed.

FIG. 9 in this regard shows a light module 10 according to the invention. The carrier plate 3 is secured to the heat sink 6, for example bonded thereto.

The heat sink 6, which is also illustrated in FIG. 2, has two portions 6*a*, 6*a'*, which are arranged at right angles to one another. The carrier plate 3 is arranged on one of the two portions 6*a*, for example bonded thereto. The heat sink 6 also has a stop region 6*b* for the return element 7, which stop region 6*b* is formed for example in one piece with the two portions 6*a*, 6*a'*.

When positioning the reflector 1, the return element 7 rests on the stop region 6*b* and is pressed together, i.e. the return element 7 is biased between the portion 6*b* and the securing base 1', such that the securing base 1' is pressed into the reference positions 4*a*, 4*b*. In this way, the reflector 1 is held at least temporarily in this position.

As illustrated, the return element 7 is preferably connected in one piece to the reflector 1, in particular to the securing base 1' thereof.

In order to permanently (yet where necessary detachably) secure the reflector 1, the reflector 1 is secured via two securing elements 8 to the heat sink 6 (in the shown example to the portion 6*a* of the heat sink 6 to which the carrier plate 3 is secured). This is shown schematically in FIGS. 9 and 10.

Specifically, the reflector 1 is secured here via the securing base 1' thereof to the heat sink 6, such that a stable secured connection is produced.

As can also be seen in FIG. 3, the reflector 1 or securing base 1' thereof has a first supporting face 1*c* (here an inner supporting face), by means of which the base 1' rests on the printed circuit board, and also a second supporting face 1*d* (here an outer supporting face), by means of which the base 1' rests on the heat sink 6, i.e. on the portion 6*a* of the heat sink 6. In this way, the spacing between the reflector face and the at least one light source can be reliably adjusted.

The fastening elements 8 are formed for example as springs, for example as sheet metal springs, which springs are provided preferably in the form of yoke springs. The springs are preferably clipped onto the heat sink 6 and the securing base 1' in this embodiment, and the base 1' additionally also has, for example, slitted openings for fixing the securing elements 8, as shown in FIGS. 9 and 10.

For the sake of clarity, the light module 10 is illustrated here with a dedicated heat sink 6, assigned only to the shown light module 10. In practice, however, a heat sink can also be provided for a plurality of light modules, such that a plurality of carrier plates with light source and light-shaping member are arranged on a single heat sink.

The invention has been explained above on the basis of a reflector, however the light-shaping member may also be an optics, for example a lens, a light guide, etc.

The invention claimed is:

1. A motor vehicle headlight with at least one light module, wherein the at least one light module comprises:

a heat sink;

a carrier plate for at least one light source secured on the heat sink; and at least one light source arranged on the carrier plate;

wherein the carrier plate has at least one reference position for referencing a reflector or other light-shaping member to the carrier plate in a specific position, wherein the reflector or other light-shaping member has a securing base, by means of which securing base the reflector or other light-shaping member can be referenced to the at least one reference position of the carrier plate, wherein the securing base is assigned at least one return element, by means of which the securing base can be secured at least temporarily in the reference position thereof in relation to the carrier plate, wherein the at least one return element in the reference position of the securing base is biased between the securing base and a stop region of the heat sink in such a way that the securing base is held in the reference position thereof in relation to the carrier plate.

2. The motor vehicle headlight of claim 1, wherein the carrier plate is bonded to the heat sink.

3. The motor vehicle headlight of claim 1, wherein the at least one light source is an LED light source which has one or more light-emitting diodes, and the carrier plate is a printed circuit board for the LED light source.

4. The motor vehicle headlight of claim 1, wherein at least one fastening element is provided in order to secure the securing base on the heat sink.

5. The motor vehicle headlight of claim 4, wherein the at least one securing element is a spring.

6. The motor vehicle headlight of claim 5, wherein the spring is a sheet metal spring.

7. The motor vehicle headlight claim 6, wherein the sheet metal spring is provided in the form of a yoke spring.

8. The motor vehicle headlight of claim 1, wherein the return element comprises at least one spring element.

9. The motor vehicle headlight of claim 8, wherein the at least one spring element is formed in one piece with the securing base.

10. The motor vehicle headlight of claim 1, wherein the at least one light source has a lightest region and the at least one reference position is arranged on the carrier plate in relation to the geometric centre of the at least one light source or in relation to the lightest region of the at least one light source.

11. The motor vehicle headlight of claim 1, wherein the at least one reference position is provided in the form of a slot or other hole or is provided in the form of a reference edge.

12. The motor vehicle headlight claim 11, wherein the at least one reference position comprises two or more reference positions running in a straight line.

13. The motor vehicle headlight of claim 1, wherein the at least one reference position is drilled and/or milled.

14. The motor vehicle headlight of claim 1, wherein the heat sink has two portions and the carrier plate is arranged on one of the portions.

15. The motor vehicle headlight of claim 14, wherein the stop region for the return element is fixed on one or both of the two portions.

16. The motor vehicle headlight claim 15, wherein the stop region is formed in one piece with one or both of the two portions.

17. The motor vehicle headlight claim 14, wherein the two portions are arranged at right angles to one another.

18. A light module for a motor vehicle or for a motor vehicle headlight, wherein the light module comprises:

a heat sink;

a carrier plate for at least one light source secured on the heat sink; and at least one light source arranged on the carrier plate;

wherein the carrier plate has at least one reference position for referencing a reflector or other light-shaping member, wherein the reflector or other light-shaping member has a securing base, by means of which securing base the reflector or other light-shaping member can be referenced to the at least one reference position of the carrier plate, wherein the securing base is assigned at least one return element, by means of which the securing base can be secured at least temporarily in the reference position thereof in relation to the carrier plate, wherein the return element comprises at least one spring element formed in one piece with the securing base, wherein the at least one return element in the reference position of the securing base is biased between the securing base and a stop region of the heat sink in such a way that the securing base is held in the reference position thereof in relation to the carrier plate.

19. A light module for a motor vehicle or for a motor vehicle headlight, wherein the light module comprises:

a heat sink;

a carrier plate for at least one light source secured on the heat sink; and at least one light source arranged on the carrier plate;

wherein the carrier plate has at least one reference position for referencing a reflector or other light-shaping member, wherein the heat sink has two portions arranged at right angles to one another and the carrier plate is arranged on one of the portions, wherein the reflector or other light-shaping member has a securing base, by means of which securing base the reflector or other light-shaping member can be referenced to the at least one reference position of the carrier plate, wherein the securing base is assigned at least one return element, by means of which the securing base can be secured at least temporarily in the reference position thereof in relation to the carrier plate, wherein the at least one return element in the reference position of the securing base is biased between the securing base and a stop region of the heat sink in such a way that the securing base is held in the reference position thereof in relation to the carrier plate.

* * * * *